United States Patent [19]

Johnston

[11] Patent Number: 5,072,549

[45] Date of Patent: Dec. 17, 1991

[54] METHOD OF CUTTING GEMSTONES AND PRODUCT

[76] Inventor: Harold Johnston, 8039 - 43rd Ave. N.E., Seattle, Wash. 98115

[21] Appl. No.: 402,657

[22] Filed: Sep. 5, 1989

Related U.S. Application Data

[63] Continuation-in-part of Ser. No. 910,173, Sep. 22, 1986, Pat. No. D. 304,698.

[51] Int. Cl.[5] ..... A44C 17/00; B23B 9/16

[52] U.S. Cl. ..... 51/283 R; 63/32

[58] Field of Search ..... 63/32; 51/283 R, 229, 51/216 LP

[56] References Cited

U.S. PATENT DOCUMENTS

| | | | |
|---|---|---|---|
| D. 36,103 | 10/1902 | Wood | 63/32 |
| D. 36,104 | 10/1902 | Wood | 63/32 |
| D. 36,131 | 11/1902 | Wood | 63/32 |
| D. 36,340 | 1/1903 | Tolkowsky | 63/32 |
| D. 74,127 | 12/1927 | Varni | 63/32 |
| D. 141,258 | 5/1945 | Fine | 63/32 |
| D. 204,199 | 3/1966 | Westreich | 63/32 |
| 236,608 | 1/1881 | Meyer | 63/32 |
| 270,018 | 1/1883 | Chevassus . | |
| 273,372 | 4/1984 | Gennari | 63/32 |
| 668,318 | 2/1901 | Patton . | |
| 693,084 | 2/1902 | Townsend | 63/32 |
| 712,155 | 10/1902 | Seddon | 63/32 |
| 809,531 | 1/1906 | Schenck | 63/32 |
| 888,346 | 5/1908 | McDearmon | 63/32 |
| 1,131,593 | 3/1915 | Boshor | 63/32 |
| 1,854,958 | 4/1932 | Santosuosso . | |
| 2,207,869 | 7/1939 | Monnier . | |
| 2,265,316 | 12/1941 | Schenck | 63/32 |
| 2,270,270 | 1/1942 | Clare | 63/32 |
| 2,340,659 | 1/1944 | Goldstein | 63/32 |
| 2,364,031 | 11/1944 | Suderov | 63/32 |
| 2,907,187 | 10/1959 | Karp . | |
| 3,039,280 | 6/1962 | Flad | 63/32 |
| 3,394,692 | 7/1968 | Sirakian . | |
| 3,435,569 | 4/1969 | Stanley | 51/229 |
| 3,439,456 | 4/1969 | Bailey | 51/229 |
| 3,528,261 | 9/1970 | Jones . | |
| 3,534,510 | 10/1970 | Leibowitz | 51/229 |
| 3,585,764 | 6/1971 | Huisman | 51/283 |
| 3,665,729 | 5/1972 | Elbe | 63/32 |
| 3,763,665 | 10/1973 | Polakiewicz | 63/32 |
| 3,788,097 | 1/1974 | Elbe | 63/32 |
| 3,796,065 | 3/1974 | Watermeyer | 63/32 |
| 3,808,836 | 5/1974 | Jones | 63/32 |
| 3,818,641 | 6/1974 | Long | 51/229 |
| 3,875,760 | 4/1975 | Jones | 63/32 |
| 4,020,649 | 5/1977 | Grossbard | 63/32 |
| 4,083,352 | 4/1978 | Andrychuck | 51/283 R |
| 4,118,949 | 10/1978 | Grossbard | 63/32 |
| 4,118,950 | 10/1978 | Grossbard | 63/32 |
| 4,306,427 | 12/1981 | Urban | 63/32 |
| 4,308,727 | 12/1982 | Elbe | 63/32 |
| 4,401,876 | 10/1983 | Cooper | 219/121 LJ |
| 4,555,916 | 12/1985 | Grossbard | 63/32 |

*Primary Examiner*—Frederick R. Schmidt
*Assistant Examiner*—Blynn Shideler
*Attorney, Agent, or Firm*—David L. Garrison; Paul L. Griffiths

[57] ABSTRACT

A method of cutting facets on a gemstone to form a pentagonal shaped gem product such that the cut facets produce a five-legged star to appear beneath the gem table. The gem product produced by this method comprises a pavilion having thirty facets and fifty edges, a crown having twenty-one facets and thirty-five facets, and a five sided girdle.

16 Claims, 4 Drawing Sheets

METHOD OF CUTTING GEMSTONES AND PRODUCT

RELATED APPLICATIONS

This application is a continuation-in-part application of the copending parent design patent application Ser. No. 910,173, filed Sept. 22, 1986 now U.S. Pat. No. 0,304,698.

TECHNICAL FIELD

This invention relates to the technical field of creating gems by cutting facets and edges on gemstones. Cutting facets and edges on gemstones improve the aesthetic appearance and value of the resulting gem product. By artfully interrelating the facets on a cut gemstone, the light refractive and reflective characteristics of the gemstone may be optimally presented to the viewer.

BACKGROUND ART

Gemstones are naturally occurring deposits of silicate and non-silicate minerals. Amethyst, citrine, rose quartz, opal, agate, tiger's-eye quartz, sapphire, ruby, emerald, moonstone, amazonite, peridot, garnet, almandite and topaz are a few silicate gemstones. Diamonds are the most highly valued non-silicate gemstones. Because gemstones are so attractive, durable and rare, they are highly valued as material from which gems are formed. The beauty of these gemstone varieties results from their color, luster, and the manner in which they transmit, refract or reflect rays of light. These properties are enchanced when the rough gemstones are cut, faceted, shaped and polished into gems.

The principal factors involved in determining the value of a cut and faceted natural gem is its weight, its depth of color, its transparency, the absence of natural inclusions, the degree of perfection of the cut and shaping, the style of the cut, including any reflected design that can be seen from its table, and its scintillation. An improvement in any of these factors correspondingly increases the value of the gem.

Most improvements relating to gems have been in the area of improved cut or facet designs or methods of manufacture. The United States Patent and Trademark Office has issued numerous patents for a variety of gem products, designs, and gem cutting methods.

Many gemstone structures are known in the prior art. Grossbard (U.S. Pat. No. 4,555,916), Elbe (U.S. Pat. No. 4,308,727), Urban (U.S. Pat. No. 4,306,427), Grossbard (U.S. Pat. No. 4,118,950), Grossbard (U.S. Pat. No. 4,118,949), Grossbard (U.S. Pat. No. 4,020,649), Jones (U.S. Pat. No. 3,875,760), Watermeyer (U.S. Pat. No. 3,796,065), Elbe (U.S. Pat. No. 3,788,097), Polakiewicz (U.S. Pat. No. 3,763,665), Elbe (U.S. Pat. No. 3,665,729), Jones (U.S. Pat. No. 3,528,261) Flad et al. (U.S. Pat. No. 3,039,280), Goldstein (U.S. Pat. No. 2,340,659) and Schenck (U.S. Pat. No. 2,265,316) all are issued United States patents for specifically designed gem products.

Gennari (U.S. Des. Pat. No. 273,372) is a design patent disclosing a specific gem product.

Karp et al. (U.S. Pat. No. 2,907,187), Santosuosso (U.S. Pat. No. 1,854,958) and Patton (U.S. Pat. No. 668,318) disclose different gem mounting devices.

Cooper (U.S. Pat. No. 4,401,876), Huisman et al. (U.S. Pat. No. 3,585,764), Leibowitz (U.S. Pat. No. 3,534,510) and Sirakian (U.S. Pat. No. 3,394,692) disclose different methods of cutting gems.

Andrychuk (U.S. Pat. No. 4,083,352), Monnier (U.S. Pat. No. 2,207,869) and Chevassus et al. (U.S. Pat. No. 270,018) disclose and claim different methods of cutting gems and the products produce by such methods.

This invention uses the concepts of "meet point faceting" as described in: Long and Steele, *Meet Point Faceting*, Volumes 1—5 1985, Sun Press, 2232-78th Ave. S.E., Mercer Island, Wash. 98040.

DISCLOSURE OF INVENTION

It is the general objective of the present invention to provide a method of manufacturing gems from gemstones which produces a pentagonal shaped gem product in which a magnificent five-sided star shape appears beneath the gem table.

Another objective of the present invention is to provide a method of cutting a gemstone into a generally pentagonal shape having a remarkable scintillation. Scintillation is the flashing, twinkling, sparkling of light, or alternating display of reflections from within a gem which may be seen because of the reflection of light from the gem's polished facets.

The invention disclosed herein is easily distinguished from the methods, designs and products described in the above mentioned patents. The present invention discloses a method of forming generally pentagonal shaped gem products in which the cut facets create a five-sided star shape to appear deep within the gem beneath the gem table. None of the cited references disclose a method, design or product which even remotely resembles the present invention.

This method combines art and technology to create a uniquely shaped gem product with unique properties and appearance. This invention teaches the precise location, size and angle of each gemstone facet and edge, and how a gemstone may be cut to maximize the weight and size of the resulting gem. Where the rough gemstone is sufficiently transparent or translucent and relatively free of natural inclusions, the gem product, produced by this method, has an extremely high degree of scintillation. Even though the angle of reflection is dependent upon the refractive index of the material used, the average scintillation of the resulting gem product is improved from approximately forty percent, which is usually found in comparable gem designs, to as high as eighty percent. This result is due to the precision cutting, angling, and positioning of the facets. The gem product may be made from any transparent or translucent material, such as from those gemstone materials listed above or from other naturally occurring or synthetic materials. Because of the differing angles of refraction of each of the listed materials, a slight adjustment or alteration of the angular settings set forth herein may be required to obtain the desired objectives of this invention. The gem product has ten facets which form a magnificent five-legged star, a grouping of twenty facets located on the pavilion which frame the star, a five-sided girdle, a grouping of fifteen facets located on the crown which further frame the reflection of the star, and a transparent flat gem table.

To achieve the unique gem cut of this invention, a precise series of steps and angular settings on a gem cutting device are required. The order of the steps is not necessarily critical. The steps are listed in the order in which the applicant prefers to perform them. The first and thirteenth steps form the gem table. The second, fourth, ninth and tenth steps form the gem girdle. The third, fourth, fifth, sixth and seventh steps form the gem pavilion. The tenth, eleventh, twelfth and thirteenth steps form the crown.

The first step rough cuts a planar gem table. The remaining steps utilize the "meet-point faceting" procedure taught in the aforementioned book.

In the second step, the sides of the girdle are formed giving the gem product a generally pentagonal shape.

A third optional step may be used to determine the maximum depth of the pavilion. The gem product should have the general configuration where the total depth of the gem product is about seventy-two percent of the gemstone's circular diameter. The depth of the crown should be about fourteen percent of the gemstone's circular diameter. The pavilion should have a depth of about fifty-six percent of the gemstone's circular diameter, and the girdle should have a depth of about two percent of the gemstone's circular diameter.

The fourth step is to cut the general shape of the pavilion so that the approximate ratio of dimensions just stated will be eventually achieved. The five facets so formed define the lower edges of the girdle and outer design framework surrounding the star.

The fifth step is to cut ten facets which abut the facets formed in the fourth step, further surrounding the star with cut facets which reflect and refract light.

The sixth step is to cut five facets which will form the surrounding background for the star pattern.

The seventh step is to cut ten facets whose edges form a five-legged star which is framed by the remaining portions of the foregoing cut facets. The legs of the star, as taught in the preferred embodiment, appear to be bifurcated and separated by the edges resulting from the intersection between these ten facets.

The eighth step is to co-axially mount the gemstone onto another dop for further working.

The optional ninth step sharpens and polishes the sides of the girdle.

The tenth step is to cut the gemstone to eventually achieve a crown and girdle having the depths as stated above. The five facets so formed define the upper edges of the girdle and the outer design framework of the crown.

The eleventh step is to cut ten facets which abut the facets formed in the tenth step, further surrounding the crown and the appearance of the star with cut facets which reflect and refract light.

The twelfth step is to cut five facets which form the outer edges of the gem table. These five facets restore the pentagonal shape to the gem table.

The optional thirteenth step sharpens and polishes the surface of the gem table.

Each facet as cut above may be polished to the desired surface characteristics at the time it is cut or the steps mentioned above may be retraced using known polishing techniques.

BRIEF DESCRIPTION OF DRAWINGS

The successive FIG. 2 to FIG. 13, illustrate the method of cutting gemstones to produce gem products which have the configuration as shown in FIG. 14 to FIG. 17, as described in accordance with the present invention.

BEST MODE FOR CARRYING OUT THE INVENTION

Figure 1:
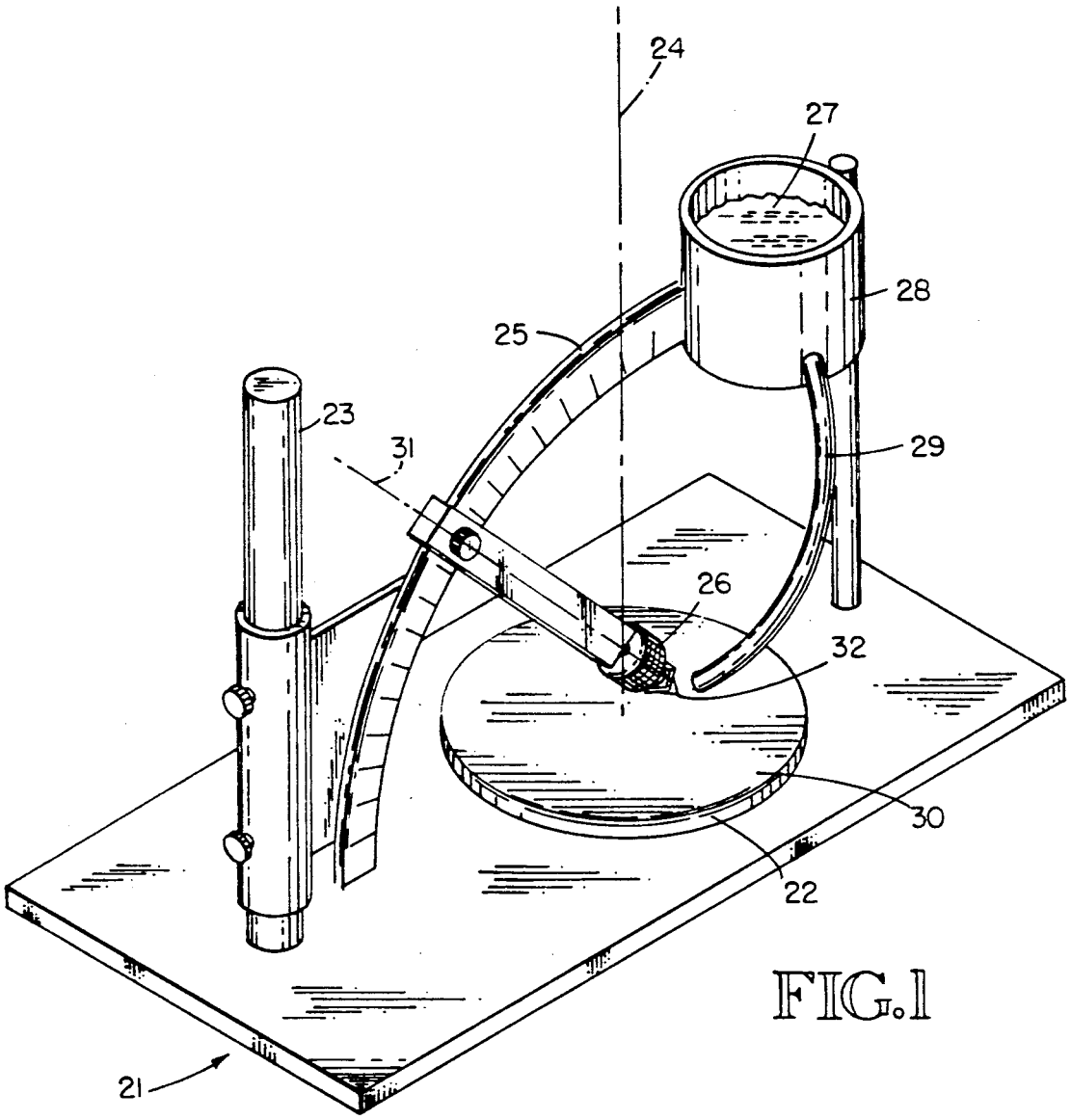
FIG. 1 is a perspective view of a gem facet-cutting device which may be used to easily implement this method and produce the product of this invention.

Referring to the drawings, wherein like numerals indicate like parts, FIG. 1 illustrates the main features of the gem facet-cutting device 21 which will be used as herein described. The gem facet-cutting device 21 has five main features: a horizontal rotating cutting wheel 22; a vertical axis member 23 which is offset and parallel to the rotational axis 24 of the cutting wheel 22; an indexed protractor 25 which is rotatably attached to the vertical axis member 23; a chuck 26 moveably mounted to the indexed protractor 25; and a source of moisture 27 which is applied in a controlled manner from a water reservoir 28, through a tube 29, to the surface of the cutting wheel 22. Laps 30 of various granulations and polishing material are attached to the horizontal surface of the cutting wheel 22 during the various stages of the cutting process. The indexed protractor 25 may be raised and lowered on the vertical axis member 23 or rotated about the vertical axis member 23. The chuck 26 may be swung horizontally on the protractor 25, rotated in accordance to the angles of the indexed protractor 25, extended or contracted along the longitudinal axis of the chuck 26, or raised or lowered in conjunction with the position of the protractor 25 on the vertical axis member 23. A device similar to the gem facet-cutting device 21 shown in FIG. 1 is manufactured by the Fac-Ette Manufacturing Company, 430 So. 96th Street #15, Seattle, Wash. 98108, (206) 767-6776, and sold under the Gem Master trademark.

For the purpose of this section, the angular settings are measured on the indexed protractor 25 from a zero degree (0°) angular setting, located at the rotational axis 24 of the cutting wheel 22, to a ninety degree (90°) angular setting, located on the same horizontal plane as the horizontal surface of a lap 30 secured upon the cutting wheel 22. The facet settings are measured radially around the longitudinal axis 31 of the gemstone 32 from a predetermined zero degree (0°) reference point. The reference point remains the same for all the steps in the procedure. In the claims, the angular settings are measured radially outward from a zero degree (0°) setting located at the longitudinal axis 31 of the gemstone 32.

Figure 2:
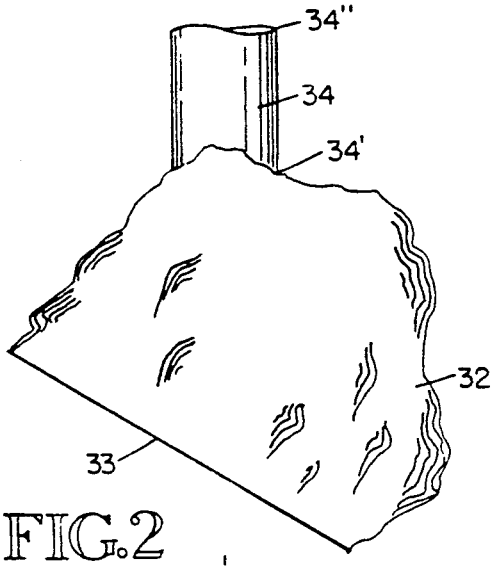
FIG. 2 is a side view of a gemstone mounted upon the first end of the first dop after a planar gem table surface has been cut.
Figure 3:
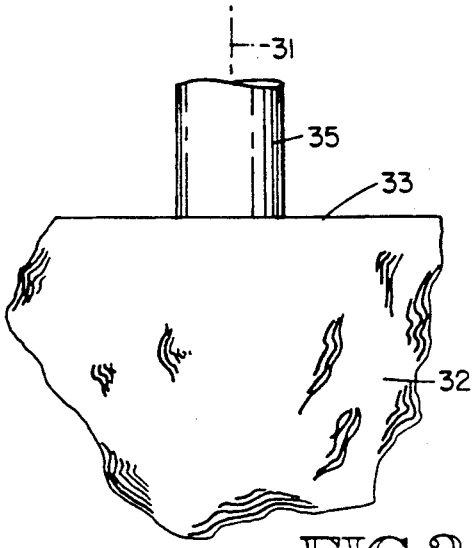
FIG. 3 is a side view of the gemstone shown in FIG. 2 mounted upon and facing the first end of the first dop, the gem table being centered around the longitudinal axis of the gemstone.

The first step is to rough cut a planar gem table 33. This is done by mounting the rough gemstone 32 onto the first end 34' of a first dop 34 as shown in FIG. 2. The second end 34'' of the first dop 34 is inserted into the chuck 26 of the gem facet-cutting device 21. The gemstone 32 is set at any appropriate angular setting. A lap 30 is placed upon the cutting wheel. The cutting wheel 22 is rotated about the rotational axis 24 and the first dop 34 is extended or lowered until the gemstone 32 contacts the rotating lap 30. As the cutting wheel 22 and lap 30 rotate, the gemstone 32 is swung back and forth across the rotating lap 30 by pivoting the chuck 26 and indexed protractor 25 about a vertical axis member 23. The swinging action prevents excessive wear to the lap 30 at any given location. A moderate supply of moisture 27 is supplied to the lap 30 to help prevent debris buildup and to maintain a low frictional temperature. The cutting procedure is continued until the proper amount of the gemstone 32 has been removed to form a properly sized planar gem table 33. The gem table 33 should be centered around the longitudinal axis 31 of the gemstone 32 and should be perpendicular to the longitudinal axis 31. The first dop 34 is then raised and removed from the chuck 26. The gemstone 32 is removed from the first dop 34 and remounted, as shown in FIG. 3, onto a second dop 35 in such a manner that the longitudinal axis 31 of the gemstone 32 is colinear with the longitudinal axis of the second dop 35. The second dop 35 is inserted into the chuck 26.

During the remaining steps the "meet-point faceting" procedure, as described in the Long and Steele books mentioned previously, will be used. Each of the facets are cut and polished with successively finer abrasive lap 30 surfaces at the angular and facet settings mentioned below until "meet-point faceting" is achieved. Throughout the cutting and polishing procedure, the longitudinal axis 31 of the gemstone 32 will be equivalent to the longitudinal axis of the chuck 26 and the dop being used.

Figure 4:
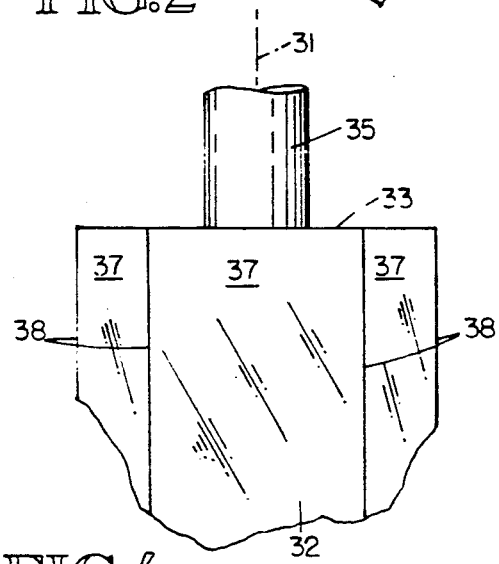
FIG. 4 is a side view of the gemstone shown in FIG. 3 after a first set of five facets has been cut.

The second step is to cut the sides of the gemstone's girdle 36. The results of the second step are illustrated in FIG. 4. Using the indexed protractor 25, the gemstone 32 is set at a ninety degree (90°) angular setting. Cuts are made at successive facet settings of 0°, 72°, 144°, 216° and 288° degrees until a first set of five equally sized facets 37 are formed. The first set of facets 37 form the planar surfaces of the girdle 36 and are perpendicular to the gem table 33. The first set of facets 37 give the gem table 33 a generally pentagonal shape. Each facet intersects the next adjacent facet along an edge to form a first set of five edges 38. In other words, the first set of facets 37 intersect each other to form a first set of edges 38. The first set of edges 38 are parallel with the longitudinal axis 31 and are perpendicular to the gem table 33.

Figure 5:
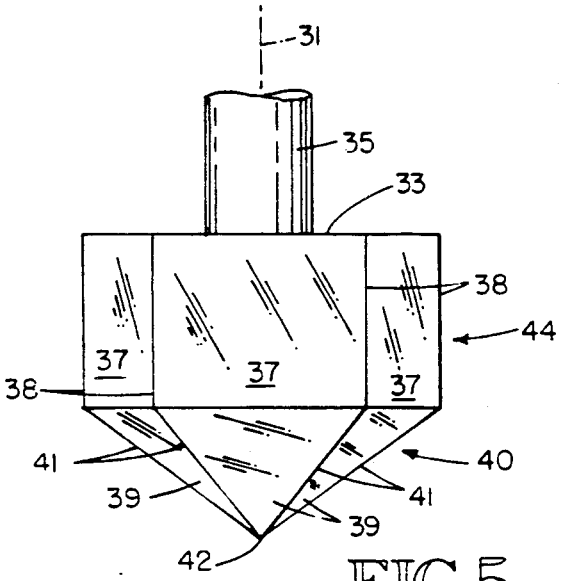
FIG. 5 is a side view of the gemstone shown in FIG. 4 after a second set of five facets has been cut.

An optional third step is for the gem cutter to estimate the the workable length of the gemstone 32. This is done by cutting a second set of five facets 39 to form a pavilion 40 on the gemstone 32, as shown in FIG. 5. Using the indexed protractor 25, the gemstone 32 is set at a fifty-four degree (54°) angular setting. Cuts are made at successive facet settings of 0°, 72°, 144°, 216° and 288°degrees until a second set of five equally sized facets 39 are formed. The second set of facets 39 intersect each other to form a twentieth set of five edges 41, which are perpendicular to the gem table, and a rough or second apex 42. The second apex 42 is positioned on the longitudinal axis 31 opposite to the gem table 33. The "meet-point faceting" procedure should be continued until not only the second set of facets 39 meet at the second apex 42 but until there are no remaining discontinuities on the planar or edge surfaces of the gemstone 32.

The distance between the gem table 33 and the final sixth apex 43 should be about seventy-two percent (72%) of the gemstone's 32 circular diameter as measured from the hypothetical diameter of the gem table 33. The depth of the crown 44 should be approximately fourteen percent (14%) of the gemstone's diameter as measured down the gemstone's longitudinal axis 31 from the upper surface of the gem table 33. The pavilion 40 should extend a distance of approximately fifty-six percent (56°) of the gemstone's diameter up the gemstone's longitudinal axis 31 from the final sixth apex 43. The depth of the girdle 36 will be approximately two percent (2%) of the gemstone's diameter.

Figure 6:
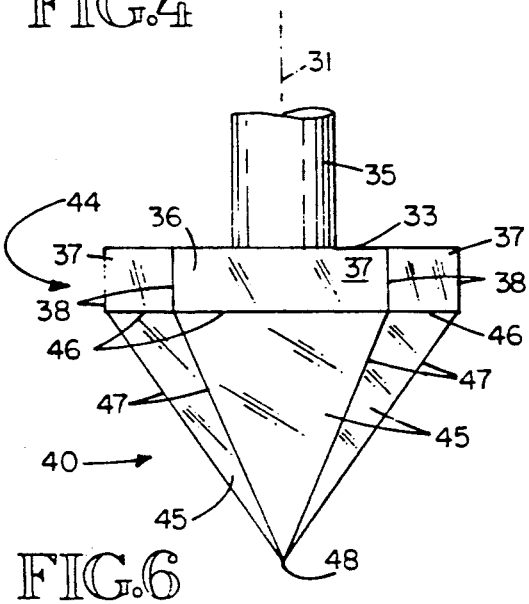
FIG. 6 is a side view of the gemstone shown in FIG. 5 after a third set of five facets has been cut.

With these approximate dimensions in mind, the fourth step is to cut the pavilion 40 in a manner that the lower edges of the girdle 36 will be produced. The results of the fourth step are indicated in FIG. 6. Using the indexed protractor 25, the gemstone 32 is set at a seventy degree (70°) angular setting. Cuts are made at successive facet settings of 0°, 72°, 144°, 216° and 288°degrees until a third set of five equally sized facets 45 are forged. The intersection of the first and third set facets 37, 45, form a second set of five edges 46. The second set of edges 46, which are parallel to the gem table 33, form the lower edge of the gem girdle 36. The third set of facets 45 intersect each other to form a third set of five edges 47 and a third apex 48. The third apex 48 is positioned on the longitudinal axis 31 opposite to the gem table 33.

Figure 7:
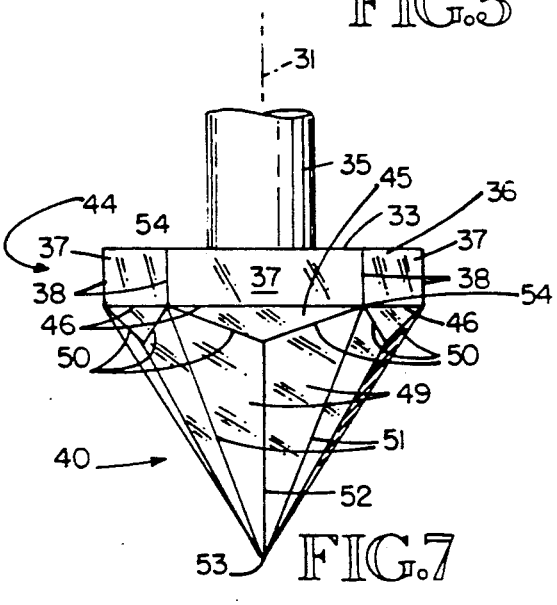
FIG. 7 is a side view of the gemstone shown in FIG. 6 after a fourth set of ten facets has been cut.

The fifth step is to cut a fourth set of ten facets 49. The results of the fifth step are indicated in FIG. 7. Using the indexed protractor 25, the gemstone 32 is set at a sixty-one degree (61°) angular setting. Cuts are made at successive facet settings of 355.5°, 4.5°, 67.5°, 76.5°, 139.5°, 148.5°, 211.5°, 220.5°, 283.5° and 292.5° degrees until a fourth set of ten equally sized facets 49 are formed. The intersection of the third and fourth set of facets 45,49, form a fourth set of ten edges 50. The fourth set of facets 49 intersect each other to form a fifth set of five edges 51, a sixth set of five edges 52 and a fourth apex 53. The fifth and sixth set of edges 51, 52 intersect each other at the fourth apex 53. The fourth apex 53 is positioned on the longitudinal axis 31 opposite the gem table 33. The first, second, fourth and fifth set of edges 38, 46, 50, 51, intersect each other to form a first set of five points 54.

Figure 8:
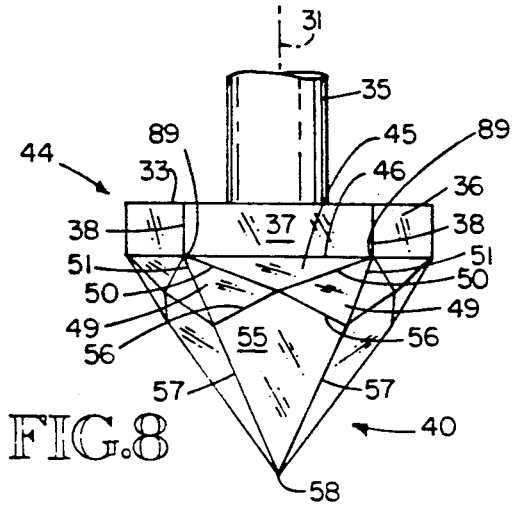
FIG. 8 is a side view of the gemstone shown in FIG. 7 after a fifth set of five facets has been cut.

The sixth step is to cut a fifth set of five facets 55. The results of the sixth step are indicated in FIG. 8. Using the indexed protractor 25, the gemstone 32 is set at a 54 degree (54°) angular setting. Cuts are made at successive facet settings of 0°, 72°, 144°, 216° and 288° degrees until a fifth set of five equally sized facets 55 are formed. The intersection of the fourth and fifth set facets 49, 55, form a seventh set of ten edges 56. The fifth set of edges 55 intersect each other to form an eighth set of five edges 57 and a fifth apex 58. The eighth set of edges 57 intersect each other at the fifth apex 58. The fifth apex 58 is positioned on the longitudinal axis 31 opposite the gem table 33. The fourth and seventh set of edges 50, 56, intersect each other to form a second set of five points 59.

Figure 9:
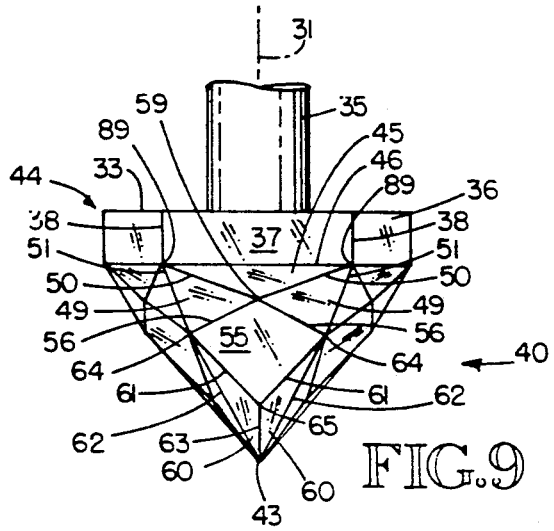
FIG. 9 is a side view of the gemstone shown in FIG. 8 after a sixth set of ten facets has been cut.

The seventh step is to cut a sixth set of ten facets 60. The sixth set of facets 60 define the parametric boundaries of the five-legged star which is the main artistic design produced by the present invention. The results of the seventh step are indicated in FIG. 9. Using the indexed protractor 25, the gemstone 32 is set at a forty-five degree (45°) angular setting. Cuts are made at successive facet settings of 18°, 54°, 90°, 126°, 162°, 198°, 234°, 270°, 306° and 342° degrees until a sixth set of ten equally sized facets 60 are formed. The intersection of the fifth and sixth set of facets 55, 60, form a ninth set of ten edges 61. The sixth set of facets 60 intersect each other to form a tenth set of five edges 62, an eleventh set of five edges 63 and a sixth apex 43. The tenth and eleventh set of edges 62, 63, intersect each other at the sixth apex 43. The tenth and eleventh set of edges 62, 63, bifurcate and separate each of the five legs of the star. The sixth apex 43 is positioned on the longitudinal axis 31 opposite the gem table 33. The fifth, seventh, ninth and tenth set of edges 51, 56, 61, 62, intersect each other to form a third set of five points 64. The ninth and eleventh set of edges 61, 63, intersect each other to form a fourth set of five points 65.

The eighth step is to co-axially mount a third dop 66 on the pavilion 40 end of the gemstone 32 and remove the second dop 35 from the gem table 33. This is done by removing the second dop 35 from the chuck 26 of the gem facet-cutting device 21 and clamping it axially in a "V"-block. A third dop 66 is placed into an adjacent "V"-block with the longitudinal axis of each dop being co-axial. The pavilion 40 of the gemstone 32 is then attached to the third dop 66 and the second dop 35 is removed from the gem table 33. The third dop 66 is placed in the chuck 26 of the gem facet-cutting device 21 and all reference points are reestablished so that the preexisting pentagonal shape will be maintained.

Figure 10:
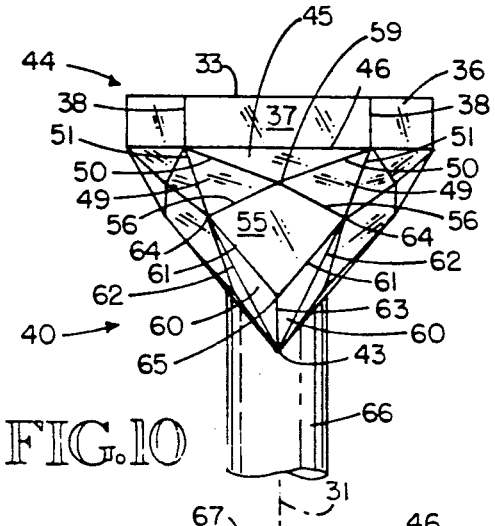
FIG. 10 is a side view of the gemstone shown in FIG. 9 with a first end of a second dop mounted to the pavilion side of the gemstone.

An optional ninth step is to sharpen, finish and polish the first set of facets 37 which form the sides of the gemstone's girdle 36. This is done by following the same procedures as explained in the second step. The results of the ninth step are indicated in FIG. 10.

Figure 11:
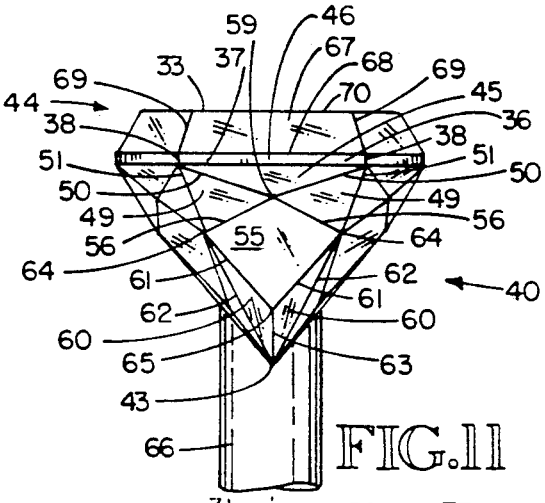
FIG. 11 is a side view of the gemstone shown in FIG. 10 after the seventh set of five facets has been cut.

The tenth step is to cut the crown 44 in a manner that the upper edges of the girdle 36 will be produced. The results of the tenth step are indicated in FIG. 11. Using the indexed protractor 25, the gemstone 32 is set at a fifty-five degree (55°) angular setting. Cuts are made at successive facet settings of 0°, 72°, 144°, 216° and 288°degrees until a seventh set of five equally sized facets 67 are formed. The intersection of the first and seventh set facets 37, 67, form a twelfth set of five edges 68. The twelfth set of edges 68, which are parallel to the gem table 33, form the upper edge of the gem girdle 36. The twelfth set of edges 68 are located a distance of approximately 14 percent (14%) of the gemstone's diameter down the longitudinal axis 31 of the gemstone 32 from the gem table 33. The seventh set of facets 67 intersect each other to form a thirteenth set of five edges 69. The gem table 33 and seventh set of facets 67 intersect each other to form a fourteenth set of five edges 70.

Figure 12:
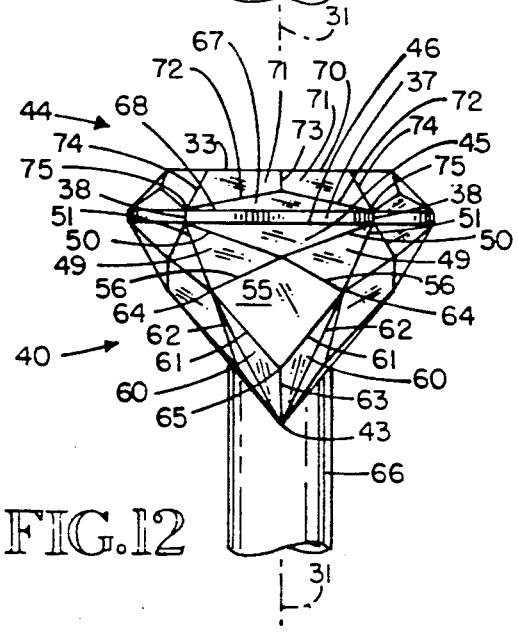
FIG. 12 is a side view of the gemstone shown in FIG. 11 after the eighth set of ten facets has been cut.

The eleventh step is to cut the eighth set of ten facets 88. The results of the eleventh step are indicated in FIG. 12. Using the indexed protractor 25, the gemstone 32 is set at a forty-one degree (41°) angular setting. Cuts are made at successive facet settings of 355.5°, 4.5°, 67.5°, 76.5°, 139.5°, 148.5°, 211.5°, 220.5°, 283.5° and 292.5° degrees until a eighth set of ten equally sized facets 71 are formed. The intersection of the seventh and eighth set of facets 67, 71, form a fifteenth set of ten edges 72. The eighth set of facets 71 intersect each other to form a sixteenth and a seventeenth set of five edges 73, 74. The first, twelfth, fifteenth and seventeenth set of edges 38, 68, 72, 74, intersect to form a fifth set of five points 75.

Figure 13:
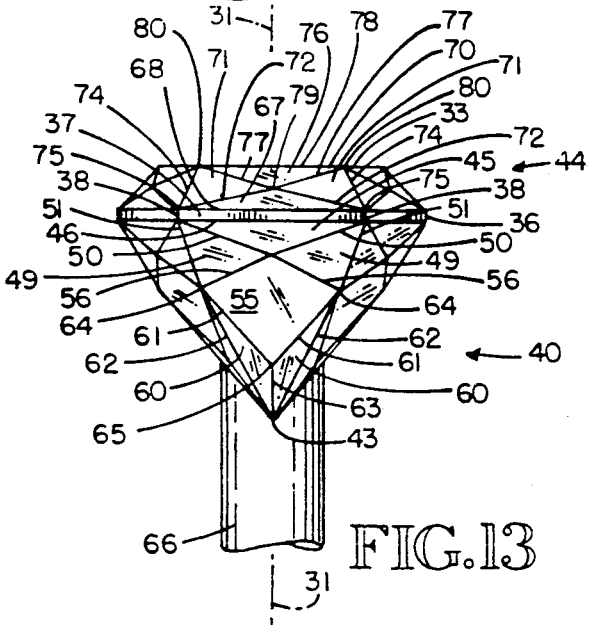
FIG. 13 is a side view of the gemstone shown in FIG. 12 after the ninth set of five facets has been cut.
Figure 14:
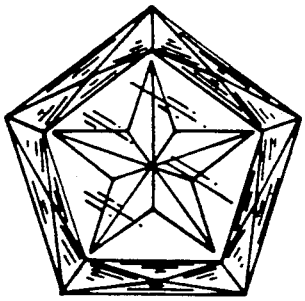
FIG. 14 is a top plan view illustrating the crown of a gem made in accordance with this invention.
Figure 15:
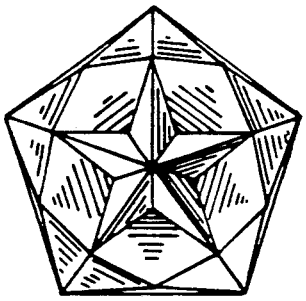
FIG. 15 is a bottom plan view illustrating the pavilion of the gem shown in FIG. 14.
Figure 16:
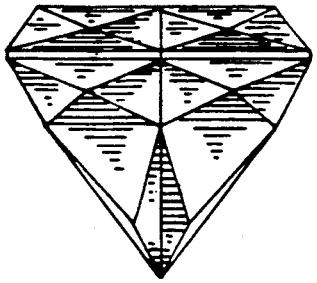
FIG. 16 is a first side elevational view of the gem shown in FIG. 14.
Figure 17:
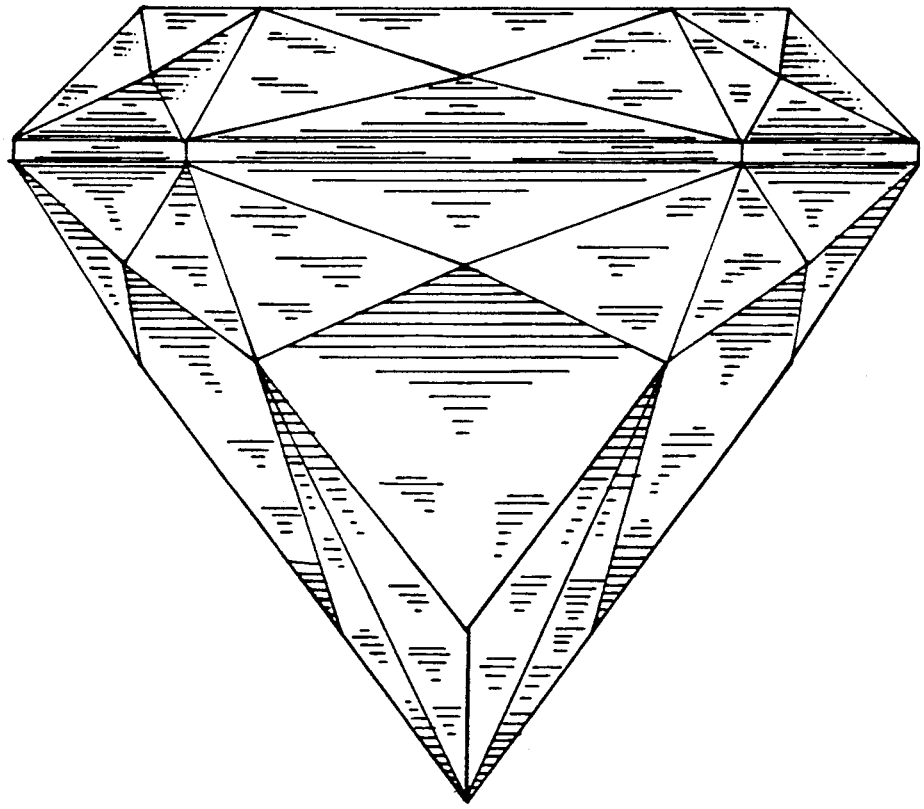
FIG. 17 is another side elevational view of the gem shown in FIG. 14.

The twelfth step is to cut the ninth set of five facets 76. The results of the twelfth step are indicated in FIG. 13. Using the indexed protractor 25, the gemstone 32 is set at a thirty degree (30°) angular setting. Cuts are made at successive facet setting of 0°, 72°, 144°, 216° and 288° degrees until a ninth set of five equally sized facets 76 are formed. The intersection of the eighth and ninth set of facets 71, 76, form an eighteenth set of ten edges 77. The ninth set of facets 76 intersect with the gem table 33 to form a nineteenth set of five edges 78. The fifteenth and eighteenth set of edges 72, 77, intersect to form a sixth set of five points 79. The thirteenth, eighteenth and nineteenth set of edges 69, 77, 78, intersect each other to form a seventh set of five points 80.

An optional thirteenth step is to sharpen, finish and polish the gem table 33. This is done by setting the gemstone 32 at a zero degree (0°) angular setting, which means that the gem table 33 is parallel to the surface of the lap 30 attached to the rotating cutting wheel 22. The gemstone 32 is lowered until the gemstone 32 contacts the lap 30. The meet-point faceting procedure is again followed.

The gemstone 32 is removed from the third dop 66 and any remaining adhesive is removed. The configuration of the resulting gem product is shown in FIG. 14 to FIG. 17.

This invention may be carried out upon traditional gemstone 32 material, such as: amethyst, citrine, quartz, opal, agate, sapphire, ruby, emerald, moonstone, amazonite, peridot, garnet, almandite, topaz, and diamond; or upon any other transparent or translucent material, such as glass, which is sufficiently hard enough to not break apart when being cut. The applicant prefers to use blue topaz material in the preferred embodiment. The angular settings and facet settings stated herein are only illustrative The above mentioned angles may be altered due to human or machine error. The angles may also be altered in order to take advantage of the reflective qualities of the material which is being used, since such material may have a different refractive index than that of blue topaz.

INDUSTRIAL APPLICABILITY

This invention can be used to manufacture gem products having a magnificent five-legged star design surrounded by multiple reflective and refractive facets appearing beneath a multi-faceted crown and gem table.

I claim:

1. A method of cutting a gemstone comprising the steps of:

(a) cutting a planar gem table on said gemstone, said gemstone having a longitudinal axis, said gem table being approximately centered around said longitudinal axis, said gem table being approximately perpendicular to said longitudinal axis;

(b) cutting a first set of five facets, said first set of facets being approximately perpendicular to said gem table, said first set of facets giving said gem table a generally pentagonal shape, said first set of facets intersecting each other to form a first set of five edges, said first set of edges being approximately perpendicular to said gem table;

(c) cutting a third set of five facets, said first and third set of facets intersecting each other to for a second set of five edges, said second set of edges being approximately parallel to said gem table, said second set of edges forming a lower edge of a gem girdle, said third set of facets intersecting each other to form a third set of five edges and a third apex, said third apex being positioned approximately on said longitudinal axis opposite to said gem table;

(d) cutting a fourth set of ten facets, said third and fourth set of facets intersecting each other to form a fourth set of ten edges, said fourth set of facets intersecting each other to form a fifth set of five edges, a sixth set of five edges and a fourth apex, said fourth apex being positioned approximately on said longitudinal axis opposite to said gem table, said fifth and sixth set of edges intersecting each other at said fourth apex, said first, second, fourth and fifth set of edges intersecting each other to form a first set of five points;

(e) cutting a fifth set of five facets, said fourth and fifth set of facets intersecting each other to form a seventh set of ten edges, said fifth set of facets intersecting each other to form an eighth set of five edges and a fifth apex, said fifth apex being positioned approximately on said longitudinal axis opposite to said gem table, said eighth set of edges intersecting each other at said fifth apex, said fourth and seventh set of edges intersecting each other to form a second set of five points;

(f) cutting a sixth set of ten facets, said fifth and sixth set of facets intersecting each other to form a ninth set of ten edges, said sixth set of facets intersecting each other to form a tenth set of five edges, an eleventh set of five edges and a sixth apex, said sixth apex being positioned approximately on said longitudinal axis opposite to said gem table, said tenth and eleventh set of edges intersecting each other at said sixth apex, said fifth, seventh, ninth and tenth set of edges intersecting each other to form a third set of five points, said ninth and eleventh set of edges intersecting each other to form a fourth set of five points;

(g) cutting a seventh set of five facets, said first and seventh set of facets intersecting each other to form a twelfth set of five edges, said twelfth set of edges being approximately parallel to said gem table, said twelfth set of edges forming an upper edge of said gem girdle, said seventh set of edges intersecting each other to form a thirteenth set of five edges, said gem table and said seventh set of facets intersecting each other to form a fourteenth set five edges;

(h) cutting an eighth set of ten facets, said seventh and eight set of facets intersecting each other to form a fifteenth set of ten edges, said eighth set of facets intersecting each other to form a sixteenth set of five edges and a seventeenth set of five edges, said first, twelfth, fifteenth and seventeenth set of edges intersecting each other to form a fifth set of five points; and (i) cutting a ninth set of five facets, said eight and ninth set of facets intersecting each other to form an eighteenth set of ten edges, said ninth set of facets intersecting with said gem table to form a nineteenth set of five edges, said fifteenth and eighteenth set of edges intersecting each other to form a sixth set of five points, said thirteenth, eighteenth and nineteenth set of edges intersecting each other to form a seventh set of five points.

2. The method as described in claim 1, wherein said step of cutting said first set of facets comprises cutting said first set of facets at approximately a 90 degree angle to said gem table at intervals of approximately 0, 72, 144, 216 and 288 degrees about said longitudinal axis as measured from a reference point.

3. The method as described in claim 1, wherein said step of cutting said third set of facets comprises cutting said third set of facets at approximately a 20 degree angle to said longitudinal axis at intervals of approximately 0, 72, 144, 216 and 288 degrees about said longitudinal axis as measured from a reference point.

4. The method as described in claim 1, wherein said step of cutting said fourth set of facets comprises cutting said fourth set of facets at approximately a 29 degree angle to said longitudinal axis at intervals of approximately 355.5, 4.5, 67.5, 76.5, 139.5, 148.5, 211.5, 220.5, 283.5 and 292.5 degrees about said longitudinal axis as measured from a reference point.

5. The method as described in claim 1, wherein said step of cutting said fifth set of facets comprises cutting said fifth set of facets at approximately a 36 degree angle to said longitudinal axis at intervals of approximately 0, 72, 144, 216 and 288 degrees about said longitudinal axis as measured from a reference point.

6. The method as described in claim 1, wherein said step of cutting said sixth set of facets comprises cutting said sixth set of facets at approximately a 45 degree angle to said longitudinal axis at intervals of approximately 18, 54, 90, 126 162, 198, 234, 270, 306 and 342 degrees about said longitudinal axis as measured from a reference point.

7. The method as described in claim 1, wherein said step of cutting said seventh set of facets comprises cutting said seventh set of facets at approximately a 35 degree angle to said longitudinal axis at intervals of approximately 0, 72, 144, 216 and 288 degrees about said longitudinal axis as measured from a reference point.

8. The method as described in claim 1, wherein said step of cutting said eighth set of facets comprises cutting said eighth set of facets at approximately a 49 degree angle to said longitudinal axis at intervals of approximately 355.5, 4.5, 67.5, 76.5, 139.5, 148.5, 211.5, 220.5, 283.5 and 292.5 degrees about said longitudinal axis as measured from a reference point.

9. The method as described in claim 1, wherein said step of cutting said ninth set of facets comprises cutting said ninth set of facets at approximately a 60 degree angle to said longitudinal axis at intervals of approximately 0, 72, 144, 216 and 288 degrees about said longitudinal axis as measured from a reference point.

10. The method as described in claim 1, further comprising the step of sharpening, finishing and polishing said first set of facets after said sixth set of facets have been cut.

11. The method as described in claim 1, further comprising the step of sharpening, finishing and polishing said gem table after said ninth set of facets have been cut.

12. The method as described in claim 1, further comprising cutting a second set of five facets, said second set of facets intersecting each other to form a second apex, said second apex being positioned approximately on said longitudinal axis opposite to said gem table.

13. The method as described in claim 12, wherein said step of cutting said second set of facets comprises cutting said second set of facets at approximately a 36 degree angle to said longitudinal axis at intervals of approximately 0, 72, 144, 216 and 288 degrees about said longitudinal axis as measured from a reference point.

14. The method as described in claim 1, wherein the material of said gemstone is a transparent material.

15. The method as described in claim 1, wherein the material of said gemstone is a translucent material.

16. The method as described in claim 1, wherein the material of said gemstone is selected from the group consisting essentially of: amethyst; citrine; quartz; opal; agate; sapphire; ruby; emerald; moonstone; amazonite; peridot; garnet; almandite; topaz; diamond; and glass.

* * * * *